US007442877B2

(12) United States Patent
Kamata et al.

(10) Patent No.: US 7,442,877 B2
(45) Date of Patent: Oct. 28, 2008

(54) WIRE MANUFACTURING METHOD WIRE MANUFACTURING APPARATUS AND WIRE

(75) Inventors: Tekeshi Kamata, Shizuoka (JP); Shigeharu Suzuki, Shizuoka (JP); Keigo Sugimura, Shizuoka (JP); Kiyoshi Yagi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/490,731

(22) PCT Filed: Oct. 11, 2002

(86) PCT No.: PCT/JP02/10580

§ 371 (c)(1),
(2), (4) Date: Feb. 23, 2005

(87) PCT Pub. No.: WO03/034449

PCT Pub. Date: Apr. 24, 2003

(65) Prior Publication Data

US 2005/0129855 A1 Jun. 16, 2005

(30) Foreign Application Priority Data

Oct. 12, 2001 (JP) ..... 2001-316007
Oct. 12, 2001 (JP) ..... 2001-316008
Oct. 12, 2001 (JP) ..... 2001-316009

(51) Int. Cl.
*H01B 7/00* (2006.01)
*H01B 7/36* (2006.01)

(52) U.S. Cl. ..... 174/110 R; 174/112

(58) Field of Classification Search ..... 174/110 R, 174/112, 113 R, 120 R; 324/500, 541, 543, 324/770; 116/200, 207, 211, 216
See application file for complete search history.

(56) References Cited

U.S. PATENT DOCUMENTS 1,968,903 A * 8/1934 Norton ..... 174/112
2,581,180 A * 1/1952 Entwistle et al. ..... 118/221

(Continued)

FOREIGN PATENT DOCUMENTS

DE 32 19 569 A1 12/1983

(Continued)

OTHER PUBLICATIONS

European search report dated Oct. 31, 2006.

*Primary Examiner*—William H Mayo, III
(74) *Attorney, Agent, or Firm*—Kratz, Quintos & Hanson, LLP

(57) ABSTRACT

This invention intends to provide a method and apparatus for manufacturing an electric wire, capable of easily changing a color applied to the electric wire. The electric wire manufacturing apparatus intends to manufacture an electric wire composed of a core and a cladding. In step S1, the core is supplied from a supply unit. In step S2, in an extrusion cladding unit, the outer periphery of the core is coated with non-color synthetic resin by extrusion cladding to form the cladding. In step S3, the outer surface of the cladding is colored by a coloring unit. The coloring unit includes a plurality of sprayers 15 and 16. In step S3, the sprayers 15 and 16 are exchanged to operate as necessary. In step S4, in a take-up unit, the electric wire is cut into segments each having a desired length, which are wound around a drum.

12 Claims, 5 Drawing Sheets

U.S. PATENT DOCUMENTS

| | | | | | |
|---|---|---|---|---|---|
| 3,280,729 | A | * | 10/1966 | Wilcocks | 101/37 |
| 4,085,357 | A | * | 4/1978 | Ansberg et al. | 318/590 |
| 4,182,601 | A | * | 1/1980 | Hill | 425/97 |
| 4,218,580 | A | * | 8/1980 | Pound et al. | 174/107 |
| 4,397,422 | A | * | 8/1983 | Gwyn | 239/307 |
| 4,400,882 | A | * | 8/1983 | Thornton | 33/732 |
| 4,877,645 | A | * | 10/1989 | Bleich et al. | 427/117 |
| 5,153,025 | A | * | 10/1992 | Klebl et al. | 427/118 |
| 5,281,764 | A | * | 1/1994 | King et al. | 174/112 |
| 5,401,908 | A | * | 3/1995 | Rodeghero | 174/112 |
| 5,430,665 | A | * | 7/1995 | Jin et al. | 702/163 |
| 5,645,899 | A | * | 7/1997 | Unterberger | 427/558 |
| 5,922,996 | A | * | 7/1999 | Ryeczek | 174/112 |
| 6,084,181 | A | * | 7/2000 | Lilientha et al. | 174/115 |
| 6,169,251 | B1 | * | 1/2001 | Grant et al. | 174/113 R |
| 6,194,663 | B1 | * | 2/2001 | Friesen et al. | 174/110 R |
| 6,388,194 | B1 | * | 5/2002 | Ryeczek | 174/112 |
| 6,727,433 | B2 | * | 4/2004 | Tsai | 174/110 R |
| 6,825,418 | B1 | * | 11/2004 | Dollins et al. | 174/112 |
| 6,918,962 | B2 | * | 7/2005 | Kamata et al. | 118/682 |

FOREIGN PATENT DOCUMENTS

| | | | | |
|---|---|---|---|---|
| DE | 33 21 835 | A1 | | 12/1984 |
| EP | 0 520 680 | A2 | | 12/1992 |
| GB | 1 290 415 | | | 9/1972 |
| JP | 42-20004 | | | 10/1967 |
| JP | 53-35262 | | | 9/1978 |
| JP | 58-15882 | | | 3/1983 |
| JP | 61-173411 | | | 8/1986 |
| JP | 6-150744 | | | 5/1994 |
| JP | 06-150744 | | * | 5/1994 |
| JP | 06-190315 | A | * | 7/1994 |
| JP | 2003-168329 | A | * | 7/1994 |
| JP | 8-138465 | | | 5/1996 |
| JP | 10-031918 | A | * | 2/1998 |
| JP | 11-027817 | A | * | 1/1999 |
| WO | WO 95/05957 | | * | 3/1995 |

* cited by examiner

S 2 ··· EXTRUSION CLADDING STEP
S 3 ··· COLORING STEP

WIRE MANUFACTURING METHOD WIRE MANUFACTURING APPARATUS AND WIRE

TECHNICAL FIELD

This invention relates to a method and apparatus for manufacturing an electric wire composed of an electric core and an insulating cladding which clads the core, and the electric wire itself.

BACKGROUND ART

A moving body such as a motor vehicle is equipped with various electronic devices. Therefore, in order to supply electric power from a power source and a control signal from a computer to these electronic devices, a wire harness 100 is arranged in the motor vehicle. The wire harness includes plural electric wires 106 (FIG. 10) and connectors attached to the ends thereof.

The electric wire 106 is composed of a conductive core 105 (FIG. 10) and a cladding which is made of insulating synthetic resin and clads the core 105. The electric wire 106 is a "clad-wire". The electric wire 106 has been manufactured by a manufacturing apparatus 100 shown in FIG. 10. The manufacturing device illustrated in FIG. 10 includes a supply unit 101, an extrusion cladding unit 102, a cooling water bath 103 and a take-up unit 104.

In manufacturing the electric wire 106, the wire manufacturing device 100 sequentially shifts the core 105 or electric wire 106 to the supply unit 101, extrusion cladding unit 102, cooling water bath 103 and take-up unit 104. In order to shift the core 105 or electric wire 106, the wire manufacturing device 100 is provided with plural pulleys 107.

The supply unit 101 supplies the core 105 with no cladding. The extrusion cladding unit 102 extrudes the insulating synthetic resin to the periphery of the core 105 to form the cladding. The cladding water bath 103 cools the cladding which clads the core 105 with the aid of the extrusion cladding unit 102. The take-up unit 104 cuts the electric wire 106 composed of the core 105 and cladding into segments each having a prescribed length and wind them around a drum so that they are in a shipping state. Thus, the electric wire 106 is manufactured by the electric wire manufacturing apparatus 100.

The connector is composed of a conductive terminal metal fitting and a connector housing. The terminal metal fitting is attached to the end of the electric wire 106 and electrically connected to the core 105 thereof. The connector housing is formed in a box shape to accommodate the terminal metal fitting.

In assembling the wire harness, the electric wire 106 is cut into wire segments (referred to electric wires 106) each having a prescribed length. Metal fittings are attached to the ends of the wire segments. Thereafter, the terminal metal fittings are inserted into the connector housing. Thus, the wire harness is assembled.

The electric wires 106 must be distinguished in terms of the size of the core 105, substance of the cladding (presence or absence of heat-resistance) and using object. The using object is a system of a motor vehicle in which the electric wires are used, such as an air bag, ABS (Antilock Brake System), a system for supplying a control signal such as a vehicle speed and a power transmission system.

The electric wires are colored with various colors and bear markings in order to identify the using object. For this purpose, in the conventional wire manufacturing device 100 illustrated in FIG. 10, the extrusion cladding unit 102 mixes a coloring agent into the synthetic resin for the cladding. The synthetic resin and coloring agent are mixed to color the synthetic resin with the same color as the coloring agent.

The synthetic resin is extruded to the periphery of the core 105. Thus, the cladding or electric wire 106 is colored.

On the other hand, a variety of demands have been made for the motor vehicle from a user. Therefore, it has been demanded that the motor vehicle is equipped with a variety of electronic devices. Thus, as the case may be, one hundred kinds of electric wires are used for the wire harness. In this case, the electric wires 106 with a wide variety of colors are used. For this reason, the wire manufacturing device 100 is demanded to be able to change the color of the cladding.

The wire manufacturing apparatus 100 illustrated in FIG. 10, in order to change the color of the cladding (i.e. electric wire 106), the extrusion cladding unit 102 was temporarily stopped to change the coloring agent to be mixed into the synthetic resin. In this case, in order to manufacture a wide variety of electric wires with a wide variety of colors, the extrusion cladding unit 102 must be stopped frequently. This reduced the manufacturing efficiency of the electric wires 106.

In order to obviate such inconvenience, it has been proposed to change the coloring agent to be mixed into the synthetic resin while the extrusion cladding unit 102 is driven. In this case, immediately after the coloring agent has been changed, both coloring agents before and after changing are mixed into the synthetic resin so that the cladding is colored with the mixed color. Since the mixed color of the electric wire 106 is not the color corresponding to the above system, the electric wire 106 cannot be used fro the wire harness.

Thus, if the coloring agent to be mixed into the synthetic resin is changed while the extrusion cladding unit 102 is driven, the electric wire involves a portion which cannot be used for the wire harness. This led to a tendency of decreasing the of material yield of the electric wire 106.

In order to suppress the wasteful portion of the electric wire 106, i.e. suppress the material yield of the electric wire 106, in e.g. JP-A-6-150774, it is proposed to apply the liquid color ink with the same color as that of the coloring agent after changing onto the mixed area of the color agents. In this case, if the mixed color (referred to as a base color) and the coloring agent after changing are different in their hue, or the brightness of the base color is lower than that of the coloring agent after changing, the base color might be seen through the liquid color ink. In addition, in this case, the liquid color ink is applied to the cladding after formed, the liquid color ink is apt to come off from the outer surface of the cladding.

In this way, in the technique described in JP-A-6-150774, the color of the liquid color ink must be determined according to the base color. This made it difficult to change the color agent from a dark coloring agent to a bright coloring agent. Thus, the technique described in JP-A-6-150774 has a limitation in changing the coloring agent that the coloring agent must be changed into the coloring agent with lower brightness.

Further, in the conventional wire manufacturing apparatus 100, in the extrusion cladding, the coloring agent is mixed into the synthetic resin constituting the cladding. The cladding is colored at the same time as the core is coated with the cladding. Accordingly, the electric wire 106 used for the motor vehicle has about one hundred kinds of product numbers in terms of the color of the outer surface (the electric wire 106 has a vast number of product numbers inclusive of those with different wire diameters).

Thus, a wire manufacturer or wire harness manufacturer must store about one hundred electric wires with different colors of the outer surface temporarily or for a long period. Therefore, a large space is required to store the electric wires and a troublesome work is necessary to manage the product numbers of the electric wires 106.

Accordingly, a first object of this invention is to provide a method and apparatus for manufacturing an electric wire which can change the color for coloring the electric wire and electric wire itself. A second object of this invention is to provide an electric wire in which the coloring color is difficult to come off.

DISCLOSURE OF THE INVENTION

In order to attain the above first object, an embodiment of the present invention proposes a method for manufacturing an electric wire composed of a conductive core and a cladding which is made of insulating synthetic resin and clads the core, characterized by comprising:

an extrusion cladding step of cladding an outer periphery of the core with non-colored synthetic resin by extrusion cladding to form the cladding; and a coloring step of coloring an outer surface of the cladding of non-colored synthetic resin.

In this configuration, the extrusion cladding step of forming the cladding and the coloring step of coloring the electric wire are implemented individually. Therefore, by changing the color in the coloring step, the color applied to the electric wire can be easily changed. In the extrusion cladding step, the cladding is coated with the non-color synthetic resin. Therefore, the product numbers (kinds of the color of the outer surface) of the electric wire which is obtained by extrusion cladding can be reduced. In the coloring step, the outer surface of the non-colored cladding is colored. Therefore, even when the outer surface of the non-colored cladding is colored with the color having higher brightness than that of the outer surface, the non-colored resin can be hidden by the color adopted in the coloring step.

In this specification, to color the outer surface of the cladding of the electric wire is to color the outer surface of the cladding with a coloring agent. The coloring agent is a liquid material in which a coloring material (industrial organic material) is dissolved or dispersed in water or other solvent. The organic material may be dye and pigment (most of them is the organic material, and synthetic material). As the case may be, the dye is used as the pigment or the pigment is used as the dye. More specifically, in the specification, the coloring agent refers to both of a coloring solution and a paint.

The coloring solution refers to a solution in which the dye is dissolved or dispersed in a solvent. The paint refers to a solution in which the pigment is dispersed in a fluid dispersion. Therefore, when the outer surface of the cladding is colored with the coloring solution, the dye sinks into the cladding. On the other hand, the outer surface of the cladding is colored with the paint, the pigment does not sink into the cladding, but is applied onto the outer surface. Specifically, in the specification, to color the outer surface of the cladding refers to dye the outer surface of the cladding in its entirety or portion with the dye and apply the pigment on the outer surface of the cladding in its entirety or portion.

The above solvent and fluid dispersion are desired to have affinity with the synthetic resin which constitutes the cladding of the electric wire. In this case, the dye surely sinks in the cladding of the electric wire, or the pigment surely applies on the outer surface of the cladding of the electric wire.

In order to attain the first object, another embodiment of the present invention proposes a method for manufacturing an electric wire characterized in that the coloring step is executed immediately after the extrusion cladding step.

In this configuration, since the coloring step is executed immediately after the extrusion cladding step, the temperature of the cladding heated to a high temperature in the extrusion cladding step can be reduced by the evaporation heat when the coloring agent used in the coloring step is dried.

The cladding heated to the high temperature in the extrusion cladding step is colored. Thus, since the outer surface of the cladding is colored before the synthetic resin constituting the cladding is hardened, the dye of the coloring agent is liable to sink within the cladding, and the pigment of the paint is liable to bond to the outer surface of the cladding.

In order to attain the first object, another embodiment of the present invention proposes a method for manufacturing an electric wire characterized in that in the coloring step, the outer surface of the cladding is colored with a plurality of colors, and the color applied to the outer surface can be changed as necessary.

In this configuration, in the coloring step, the outer surface of the cladding can be colored with a plurality of colors, and the color applied to the outer surface can be changed. Therefore, the cladding can be colored with various colors which can be changed.

In order to attain the first object, another embodiment of the present invention proposes a method for manufacturing an electric wire characterized in that in the coloring step, any position of the electric wire is measured and the outer surface of the cladding is colored by exchanging a plurality of coloring portions capable of coloring the outer surface of the cladding in a single color, respectively.

In this configuration, any position of the electric wire is measured to exchange the plurality of coloring portions. Therefore, the electric wire can be colored with a plurality of colors. In addition, without stopping the operation of manufacturing the electric wire temporarily, the color applied to the electric wire can be easily changed. Further, any position of the electric wire can be measured. Therefore, when the coloring portions are exchanged, any overlapping portion of the first color and the second color can be avoided and the area not colored with both colors can be avoided. Therefore, the boundary between the first area colored with the first color and the second area colored with the second color can be clarified.

In order to attain the first object, another embodiment of the present invention proposes a method for manufacturing an electric wire characterized in that the core of the electric wire is moved to manufacture the electric wire; the coloring portions are apart from one another in a direction of moving the core; and when the electric wire moves over an interval between the coloring portions while an upstream coloring portion of the coloring portions is stopped, a downstream coloring portion thereof is operated.

In this configuration, the upstream coloring portion is stopped, and when the electric wire moves over an interval between the coloring portions while an upstream coloring portion of the coloring portions is stopped, the downstream coloring portion thereof is operated. Therefore, when the coloring portions are exchanged, any overlapping portion of the first color and the second color can be avoided and the area not colored with both colors can be avoided. Therefore, the boundary between the first area colored with the first color and the second area colored with the second color can be clarified.

In order to attain the first object, another embodiment of the present invention proposes a method for manufacturing an electric wire characterized in that the core of the electric wire is moved to manufacture the electric wire; the coloring portions are apart from one another in a direction of moving the core; and where an upstream coloring portion of the coloring portions is operated while a downstream coloring portion thereof is operated, when the electric wire moves over an interval between the coloring portions, the downstream portion is stopped.

In this configuration, where the upstream coloring portion of the coloring portions is operated while a downstream coloring portion thereof is operated, when the electric wire moves over an interval between the coloring portions, the downstream portion is stopped. Therefore, when the coloring portions are exchanged, any overlapping portion of the first color and the second color can be avoided and the area not colored with both colors can be avoided. Therefore, the boundary between the first area colored with the first color and the second area colored with the second color can be clarified.

In order to attain the above object, another embodiment of the present invention proposes an apparatus for manufacturing an electric wire composed of a conductive core and a cladding which is made of insulating synthetic resin and clads the core, characterized by comprising:

an extrusion cladding unit of cladding an outer periphery of the core with non-colored synthetic resin by extrusion cladding to form the cladding; and a coloring unit of coloring an outer surface of the cladding of non-colored synthetic resin.

In this configuration, the extrusion cladding unit of forming the cladding and the coloring unit of coloring the electric wire are individually provided. Therefore, by changing the color in the coloring step, the color applied to the electric wire can be easily changed. In the extrusion cladding step, the cladding is coated with the non-color synthetic resin. Therefore, the product numbers (kinds of the color of the outer surface) of the electric wire which is obtained by the extrusion cladding unit can be reduced. In the coloring unit, the outer surface of the non-colored cladding is colored. Therefore, even when the outer surface of the non-colored cladding is colored with the color having higher brightness than that of the outer surface, the non-colored resin can be hidden by the color adopted in the coloring unit.

In order to attain the first object, another embodiment of the present invention proposes an apparatus for manufacturing an electric wire characterized in that the core is moved to manufacture the electric wire, and the coloring unit is arranged downstream of and immediately after the extrusion cladding unit in a direction of moving the core.

In this configuration, since the coloring unit is arranged immediately after the extrusion cladding unit, the temperature of the cladding heated to a high temperature in the extrusion cladding unit can be reduced by the evaporation heat when the coloring agent used in the coloring unit is dried.

The cladding heated to the high temperature in the extrusion cladding unit is colored. Thus, since the outer surface of the cladding is colored before the synthetic resin constituting the cladding is hardened, the dye of the coloring agent is liable to sink within the cladding, and the pigment of the paint is liable to bond to the outer surface of the cladding.

In order to attain the first object, another embodiment of the present invention proposes an apparatus for manufacturing an electric wire characterized in that the coloring unit includes a plurality of coloring portions capable of coloring the outer surface of the cladding in a single color, respectively, and an exchanging portion for exchanging the coloring portions for coloring the outer surface of the cladding.

In this configuration, the coloring unit includes a plurality of coloring portions and the exchanging portion. Therefore, by exchanging the coloring portions to operate in the coloring unit, the outer surface of the cladding can be colored with various colors.

In order to attain the first object, another embodiment of the present invention proposes an apparatus for manufacturing an electric wire characterized in that the coloring unit includes a plurality of coloring portions capable of coloring the outer surface of the cladding in a single color, respectively, a measuring means for measuring an optional position of the electric wire, and an exchanging means for exchanging the coloring portions for coloring the outer surface of the cladding on the basis of the optional position measured by the measuring means.

In this configuration, the coloring unit includes the plurality of coloring portions. Therefore, the electric wire can be colored with the plurality of colors. In addition, the exchanging means can exchange the coloring portions. Therefore, without temporarily stopping the coloring unit, i.e. electric wire manufacturing apparatus, the color applied to the electric wire can be easily changed. Further, the measuring means can measure any position of the electric wire. Therefore, when the coloring portions are exchanged, any overlapping portion of the first color and the second color can be avoided and the area not colored with both colors can be avoided.

In order to attain the first object, another embodiment of the present invention proposes an apparatus for manufacturing an electric wire characterized in that the coloring portions are arranged apart from each other in a direction of moving the core; and the measuring means measures the optional position by measuring information corresponding to a quantity of movement of the electric wire in a direction of moving the core.

In this configuration, the measuring means measures any position of the electric wire by measuring the information corresponding to a quantity of movement of the electric wire. Therefore, when the coloring portions are exchanged, any overlapping portion of the first color and the second color can be avoided and the area not colored with both colors can be avoided.

In order to attain the first object, another embodiment of the present invention proposes an apparatus for manufacturing an electric wire characterized in that when the exchanging means changes the coloring portion for coloring the outer surface from an upstream coloring portion of the coloring portions to a downstream coloring portion thereof in a direction of moving the core, the exchanging portion stops the upstream coloring portion and operates the downstream coloring portion when a quantity of movement of the electric wire measured by the measuring means becomes equal to the interval between the plurality of coloring portions.

In this configuration, the exchanging portion stops the upstream coloring portion and operates the downstream coloring portion when a quantity of movement of the electric wire measured by the measuring means becomes equal to the interval between the plurality of coloring portions. Therefore, when the coloring portions are exchanged, any overlapping portion of the first color and the second color can be avoided and the area not colored with both colors can be avoided.

In order to attain the first object, another embodiment of the present invention proposes an apparatus for manufacturing an electric wire characterized in that when the exchanging means changes the coloring portion for coloring the outer surface from a downstream coloring portion of the coloring portions to an upstream coloring portion thereof in a direction of moving the core, the exchanging portion operates the upstream coloring portion while the downstream coloring portion is being operated, and stops the downstream coloring portion when a quantity of movement of the electric wire measured by the measuring means becomes equal to the interval between the plurality of coloring portions.

In this configuration, the exchanging portion operates the upstream coloring portion while the downstream coloring portion is being operated, and stops the downstream coloring portion when a quantity of movement of the electric wire measured by the measuring means becomes equal to the interval between the plurality of coloring portions. Therefore, when the coloring portions are exchanged, any overlapping portion of the first color and the second color can be avoided and the area not colored with both colors can be avoided.

In order to attain the first object, another embodiment of the present invention proposes an apparatus for manufacturing an electric characterized in that each of the coloring portions sprays a coloring agent in a sol state on the outer surface.

In this configuration, the coloring portion sprays the coloring agent in a sol state. Therefore, when the exchanging means exchanges the coloring portions, the color applied to the electric wire can be changed immediately.

In order to attain the second object, another embodiment of the present invention proposes an electric wire composed of a conductive core and a cladding which is made of insulating synthetic resin and clads the core, characterized in that immediately after an outer periphery of the core is coated with the synthetic resin by extrusion cladding to provide the cladding, the outer surface of the cladding is colored.

In this configuration, the cladding heated to the high temperature by the extrusion cladding is colored. Thus, since the outer surface of the cladding is colored before the synthetic resin constituting the cladding is hardened, the dye of the coloring agent is liable to sink within the cladding, and the pigment of the paint is liable to bond to the outer surface of the cladding.

In order to attain the second object, another embodiment of the present invention proposes an electric wire characterized in that a plurality of coloring portions capable of coloring the outer surface in single color, respectively are exchanged to color the outer surface at any measured position, and the outer surface is composed of a first area colored in a first color, a second area colored in a second color and a boundary therebetween.

In the configuration, any position is measured and the coloring portions are exchanged to color the outer surface. Therefore, the boundary between the first area colored with the first color and the second area colored with the second color can be clarified.

In order to attain the second object, another embodiment of the present invention proposes an electric wire characterized in that the electric wire is manufactured by moving the core; the coloring portions are apart form one another in a direction of moving the core; and after the electric wire is moved over an interval between the coloring portions while an upstream coloring portion of the coloring portions stops, a downstream coloring portion is operated.

In this configuration, an upstream coloring portion of the coloring portions is stopped, and when the electric wire is moved over an interval between the coloring portions while a downstream coloring portion is operated to color the outer surface. Therefore, when the coloring portions are exchanged, any overlapping portion of the first color and the second color can be avoided and the area not colored with both colors can be avoided. Thus, the boundary between the first area colored with the first color and the second area colored with the second color can be clarified.

In order to attain the second object, another embodiment of the present invention proposes an electric wire characterized in that the electric wire is manufactured by moving the core; the coloring portions are apart form one another in a direction of moving the core; and an upstream coloring portion of the coloring portions is operated while a downstream coloring portion thereof is being operated, and the downstream coloring portion is stopped after the electric wire moves over an interval between the coloring portions.

In this configuration, the upstream coloring portion of the coloring portions is operated while a downstream coloring portion thereof is being operated, and the downstream coloring portion is stopped after the electric wire moves over an interval between the coloring portions. Therefore, when the coloring portions are exchanged, any overlapping portion of the first color and the second color can be avoided and the area not colored with both colors can be avoided. Thus, the boundary between the first area colored with the first color and the second area colored with the second color can be clarified.

BEST MODE FOR CARRYING OUT THE INVENTION

Figure 5:
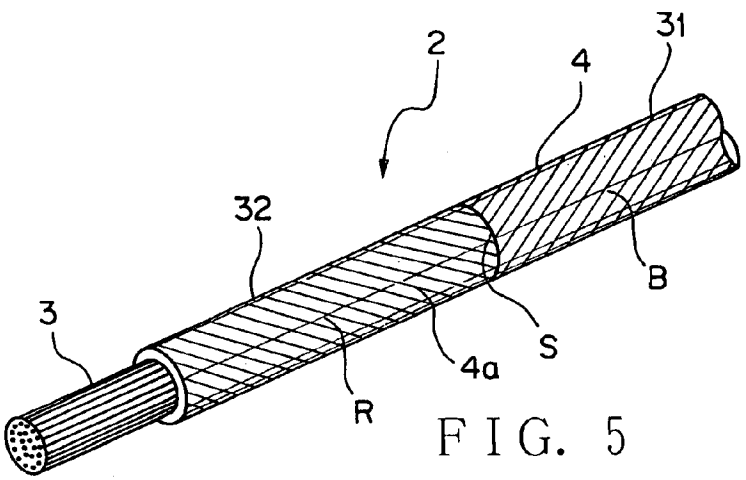
FIG. 5 is a perspective view of the wire manufactured by the wire manufacturing device as shown in FIG. 1.
Figure 4:
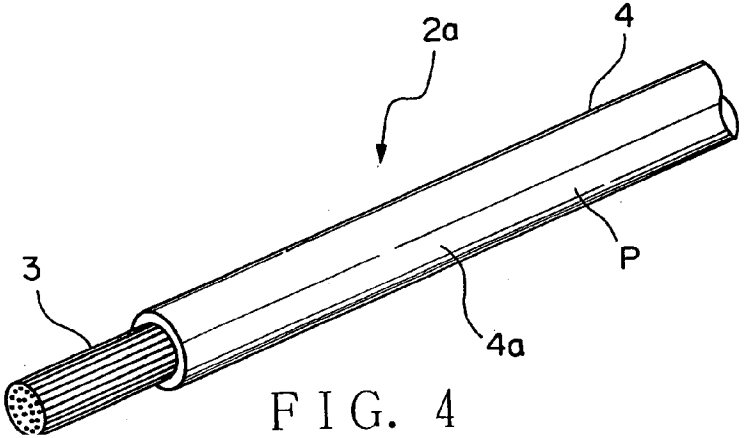
FIG. 4 is a perspective view of a non-colored wire manufactured by an extrusion cladding unit of the wire manufacturing device as shown in FIG. 1.

Now referring to FIGS. 1 to 9, an explanation will be given of a method and apparatus for manufacturing an electric wire according to an embodiment of this invention. An electric wire manufacturing apparatus shown in FIG. 1 according to an embodiment of this invention is an apparatus which once manufactures a non-colored electric wire 2*a* as shown in FIG. 4 and colors the non-colored wire 2*a* to manufacture an electric wire 2 as shown in FIG. 5. Incidentally, since these electric wires 2 and 2*a* have the same construction, their like portions are designated by like reference numerals.

The electric wire 2 constitutes the wire harness of the moving body such as a motor vehicle. The electric wire 2, 2*a*, as shown in FIGS. 4 and 5, is composed of a conductive core 3 and insulating cladding 4. The core 3 is composed of a plurality of twisted strands. The strand is made of conductive metal. The core 3 may be composed of a single strand. The cladding 4 is made of synthetic resin such as polyvinylchloride: PVC. The cladding 4 clads the core 3.

The outer surface of the cladding 4 of the non-colored electric wire 2*a*, as shown in FIG. 4, is colored with the color P of the synthetic resin itself constituting the cladding 4. In the non-colored electric wire 2*a*, the coloring agent is not mixed with the synthetic resin constituting the cladding 4. The electric wire with the outer surface 4*a* with the color P is referred to as a non-colored electric wire 2*a*.

On the other hand, the outer surface 4*a* of the cladding 4 of the electric wire 2 is colored with the color different from the synthetic resin of the cladding 4. The outer surface of the cladding 4 of the electric wire 2 is composed of a first portion 31 colored with a first color B (shaded in FIG. 5), a second portion 32 with a second color R (shaded in FIG. 5) and a boundary S therebetween. The boundary S is clearly indicated. The outer surface 4*a* of the cladding 4 constitutes the outer surface of the electric wire 2.

The electric wires each having the structure described above are tied up in a bundle. The ends of the electric wires are connected to connectors so as to constitute the wire harness described above. The connectors are connector-coupled with various connectors of electronic devices of a motor vehicle. The wire harness, i.e. electric wires transmit various signals and electric power to the electronic devices.

Figure 1:
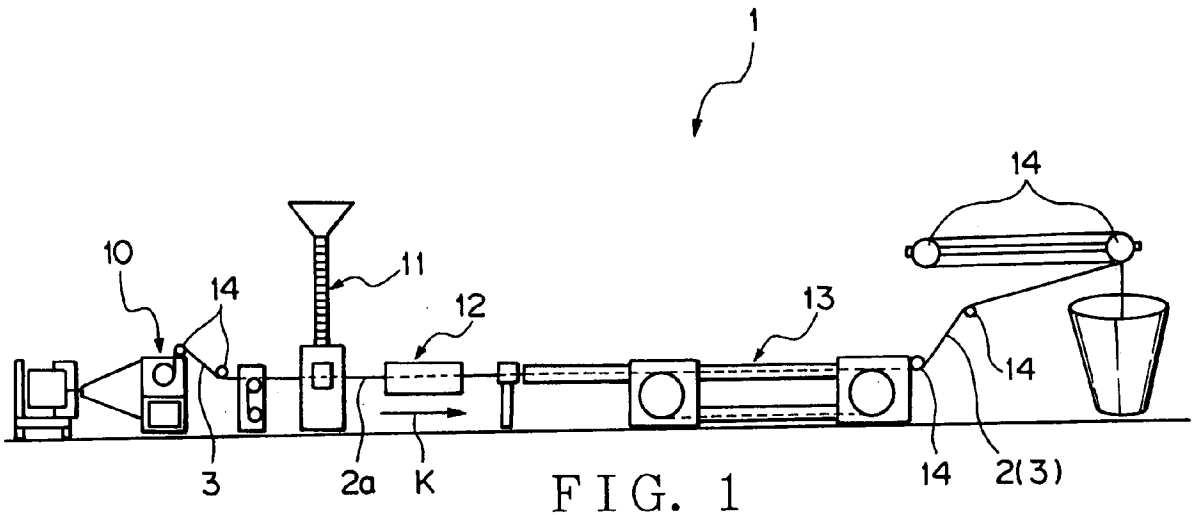
FIG. 1 is a view for explaining an electric wire manufacturing apparatus according to an embodiment of this invention.

The wire manufacturing apparatus 1 serves to manufacture the electric wires each having the structure as described above. The wire manufacturing apparatus, as shown in FIG. 1, includes a supply unit 10, an extrusion cladding unit 11, a coloring unit 12 and a take-up unit 13.

The wire manufacturing apparatus 1 sequentially shifts the core 3 to the supply unit 10, extrusion cladding unit 11, coloring unit 12 and take-up unit 13 to manufacture the electric wire 2. The wire manufacturing apparatus 1 is provided with a plurality of pulleys for shifting the core 3 or electric wire 2, 2*a*.

The supply unit 10 supplies the core 3 not coated with the cladding 4. The extrusion cladding unit 11, after has once liquefied the non-colored synthetic resin (heated it to a high temperature), applies it on the entire periphery of the core 3 supplied from the supply unit 10. The extrusion cladding unit 11 extrusion-clads the non-colored synthetic resin on the periphery of the core 3 supplied from the supply unit 10 to form the cladding 4. The extrusion cladding unit 11 manufactures the non-colored electric wire 2*a* as shown in FIG. 4. The cladding 4, immediately after it has been manufactured by the extrusion cladding unit 11 (immediately after step S2 described later), is at a high temperature.

Figure 2:
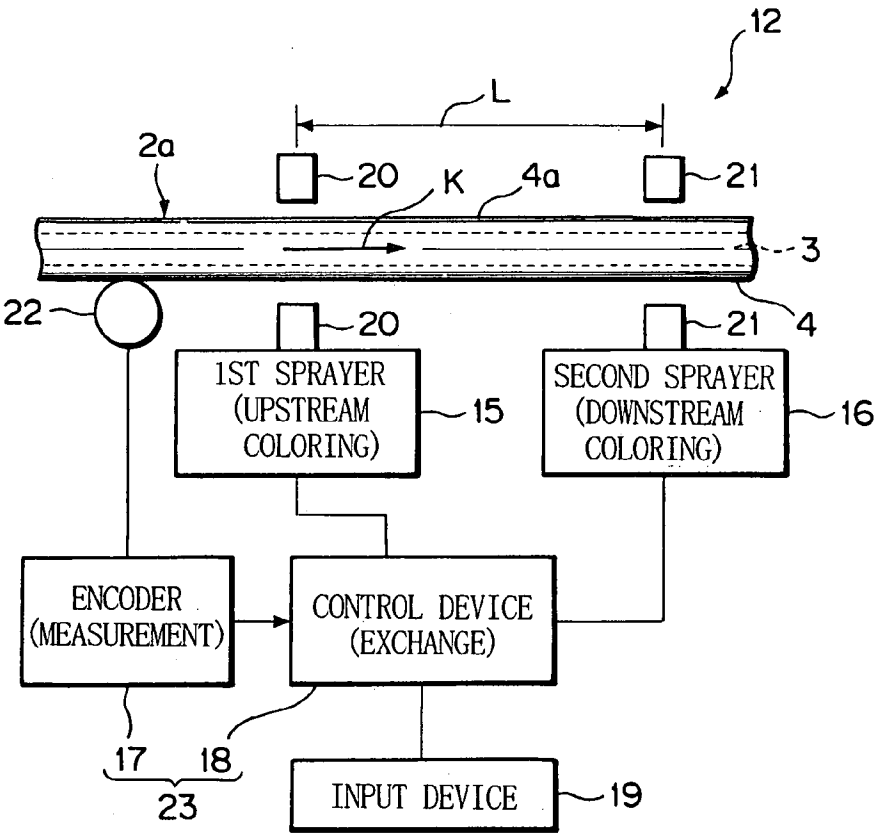
FIG. 2 is a view for explaining the structure of a coloring unit of the electric wire manufacturing apparatus shown in FIG. 1.

The coloring unit 12 is arranged downstream and immediately after the extrusion cladding unit 11 in the moving direction of the core 3 or electric wire 2, 2*a* (direction of arrow K in FIG. 2). The arrow K represents the moving direction of the core 3. The coloring unit 12 colors the outer surface 4*a* (FIG. 4) of the cladding 4 of the core 3 heated to a high temperature with a desired color. The detailed structure of the coloring unit 12 will be described later.

In this specification, to color the outer surface 4*a* of the cladding 4 of the electric wire 2 is to color the outer surface of the cladding 4 with a coloring agent. The coloring agent is a liquid material in which a coloring material (industrial organic material) is dissolved or dispersed in water or other solvent. The organic material may be dye and pigment (most of them is the organic material, and synthetic material). As the case may be, the dye is used as the pigment or the pigment is used as the dye. More specifically, in the specification, the coloring agent refers to both of a coloring solution and a paint.

The coloring solution refers to a solution in which the dye is dissolved or dispersed in a solvent. The paint refers to a solution in which the pigment is dispersed in a fluid dispersion. Therefore, when the outer surface 4*a* of the cladding 4 is colored with the coloring solution, the dye sinks into the cladding 4. On the other hand, when the outer surface 4*a* of the cladding 4 is colored with the paint, the pigment does not sink into the cladding 4, but is applied onto the outer surface 4*a*. Specifically, in the specification, to color the outer surface of the cladding 4 refers to dye the outer surface of the cladding 4 in its entirety or portion (terminal) with the dye and apply the pigment on the outer surface of the cladding 4 in its entirety or portion.

The above solvent and fluid dispersion are desired to have affinity with the synthetic resin which constitutes the cladding of the electric wire 2. In this case, the dye surely sinks in the cladding 4 of the electric wire 2, or the pigment surely applies on the outer surface 4*a* of the cladding 4 of the electric wire 2.

The take-up unit 13 cuts the electric wire 3 composed of the core 3 and the cladding 4 with the colored outer surface 4*a* into segments each having a prescribed length. The take-up unit 13 winds the electric wire around a drum and places it in an off-the-shelf state.

An explanation will be given of the construction of the coloring unit 12. The coloring unit 12, as seen from FIG. 2, includes a first sprayer 15 which is an upstream coloring portion, a second sprayer 16 which is a downstream coloring portion, an exchanging portion 23 and an input device 19 which is an input means. Namely, the coloring unit 12 is provided with a plurality of sprayers 15, 16 which serve as coloring portions. In the illustrated example, the coloring unit 12 is provided with two sprayers 15, 16, but may be provided with three or more sprayers 15, 16.

The first sprayer 15 is provided with a first plurality of nozzles 20, a first liquid supplying source (not shown) and a first gas supplying source (not shown). The first nozzles 20 are opposite to the outer surface 4*a* of the cladding 4 which clads the core 3. The first plurality of nozzles 20 are arranged at regular intervals circumferentially around the electric wire 2*a*. Arrow K denotes the direction of moving the core 3. In FIG. 2, the first sprayer 15 is provided with first two nozzles 20 on a diagonal line around the electric wire 2*a*. However, if necessary where the entire periphery of the electric wire 2*a* is colored, the first sprayer 15 may be provided with three or more first nozzles 20.

Figure 7:
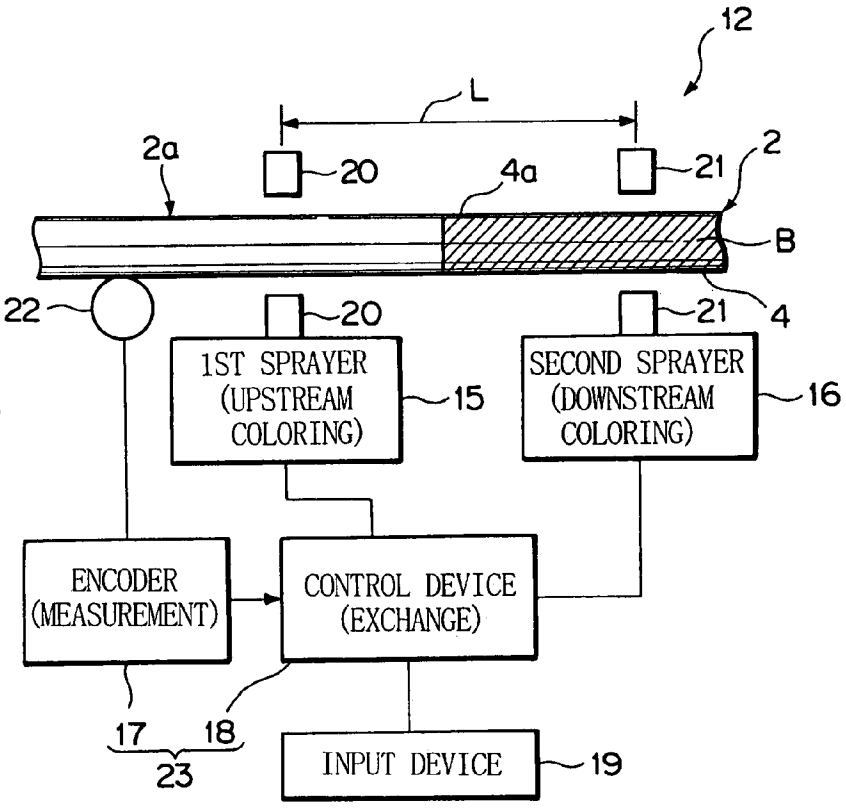
FIG. 7 is a view showing the state in which the first sprayer stops from the state of FIG. 6.
Figure 6:
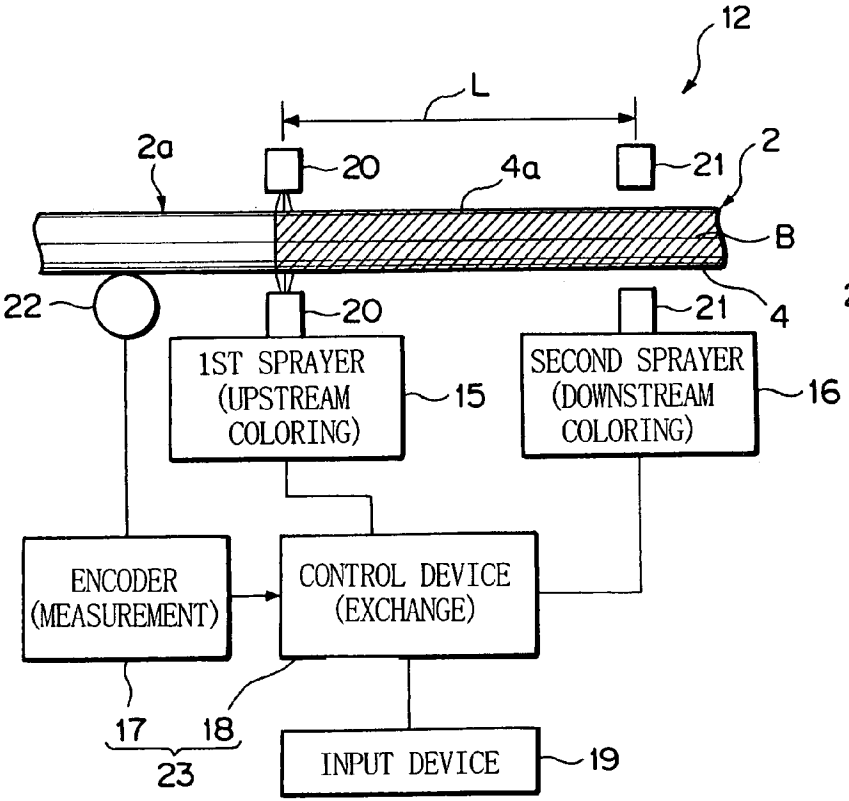
FIG. 6 is a view showing the state in which the electric wire is being colored by a first sprayer of the coloring unit shown in FIG. 2.
Figure 8:
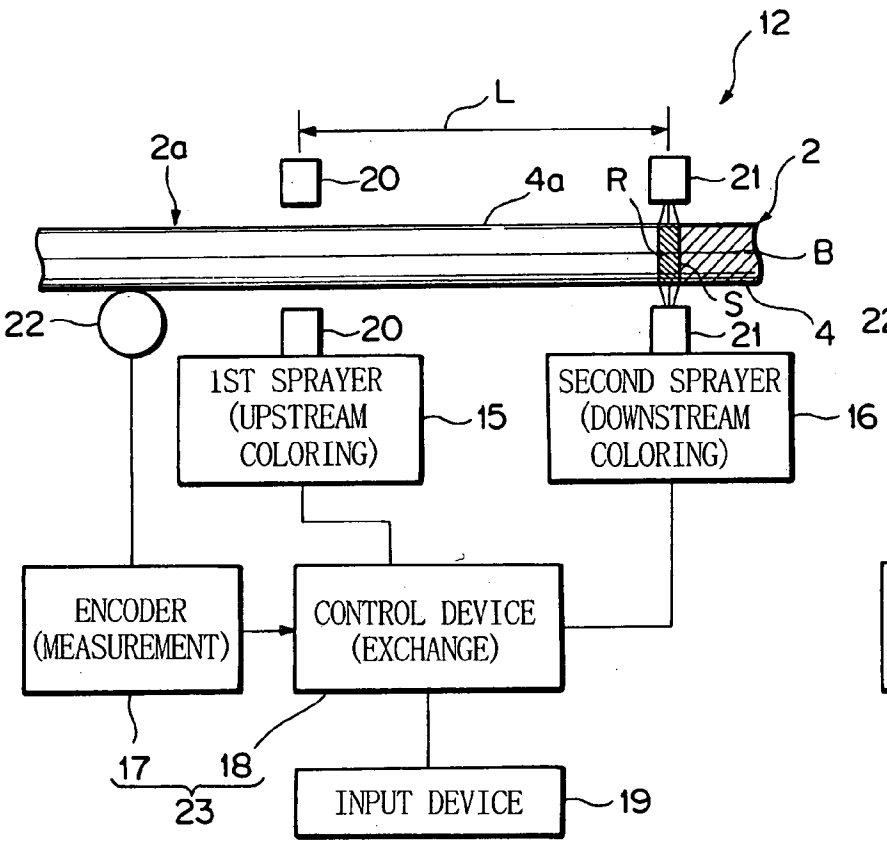
FIG. 8 is a view showing the state in which a second sprayer is operated from the state of FIG. 7.
Figure 10:
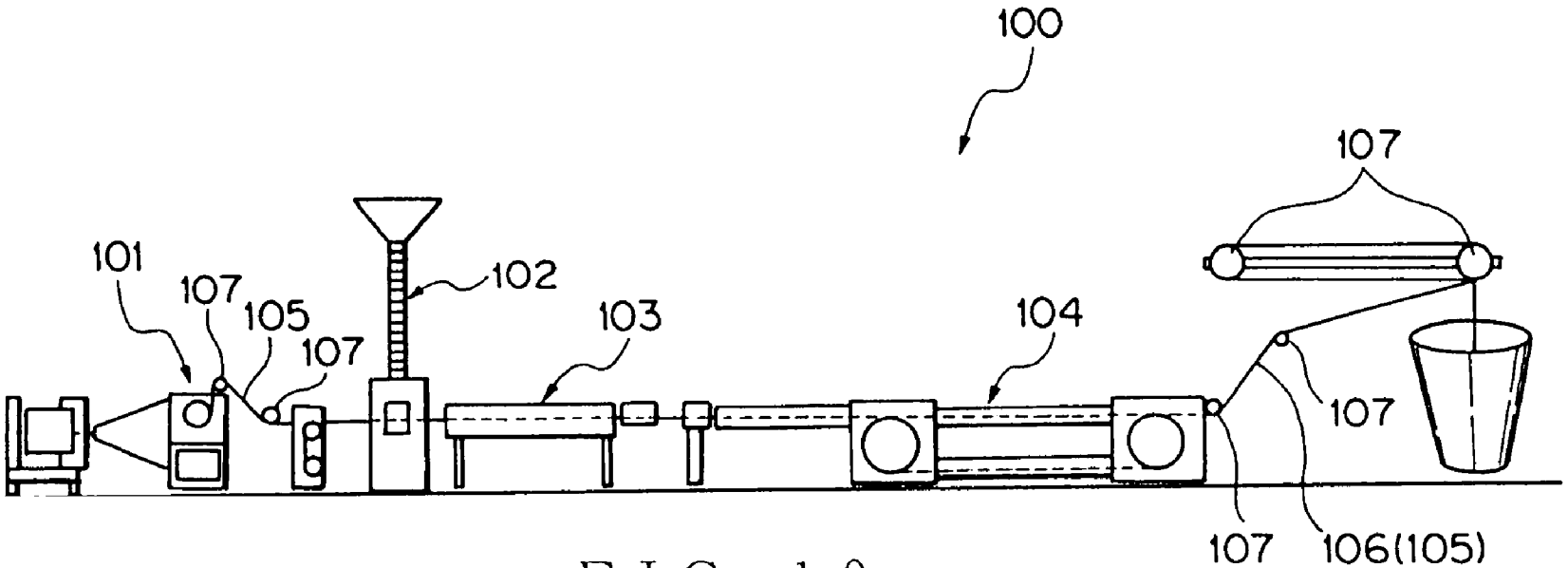
FIG. 10 PRIOR ART
FIG. 10 is a view for showing the construction of a conventional wire manufacturing device.

The first liquid supply source serves to supply the coloring liquid or paint of the first color (shaded by in FIGS. 6 to 8). The first gas supply source serves to supply pressurized gas into the first nozzle 20. In the configuration described above, the first sprayer 15 sprays the coloring liquid or paint with the first color B as well as the gas from the first nozzle 20 toward the outer surface of the cladding 4. The first sprayer 15 disperses the coloring liquid or paint (i.e. coloring agent) with the first color B into the gas so that it is sprayed to the outer surface of the cladding 4 in its "sol" (aerosol) state.

The second sprayer 16 is provided with a second plurality of nozzles 21, a second liquid supplying source (not shown) and a second gas supplying source (not shown). The second nozzles 21 are opposite to the outer surface 4*a* of the cladding 4 which clads the core 3. The second plurality of nozzles 21 are arranged at regular intervals circumferentially around the electric wire 2*a*. In FIG. 2, the second sprayer 16 is provided with second two nozzles 21 on a diagonal line around the electric wire 2*a*. However, if necessary where the entire periphery of the electric wire 2*a* is colored, the second sprayer 16 may be provided with three or more second nozzles 21.

Figure 9:
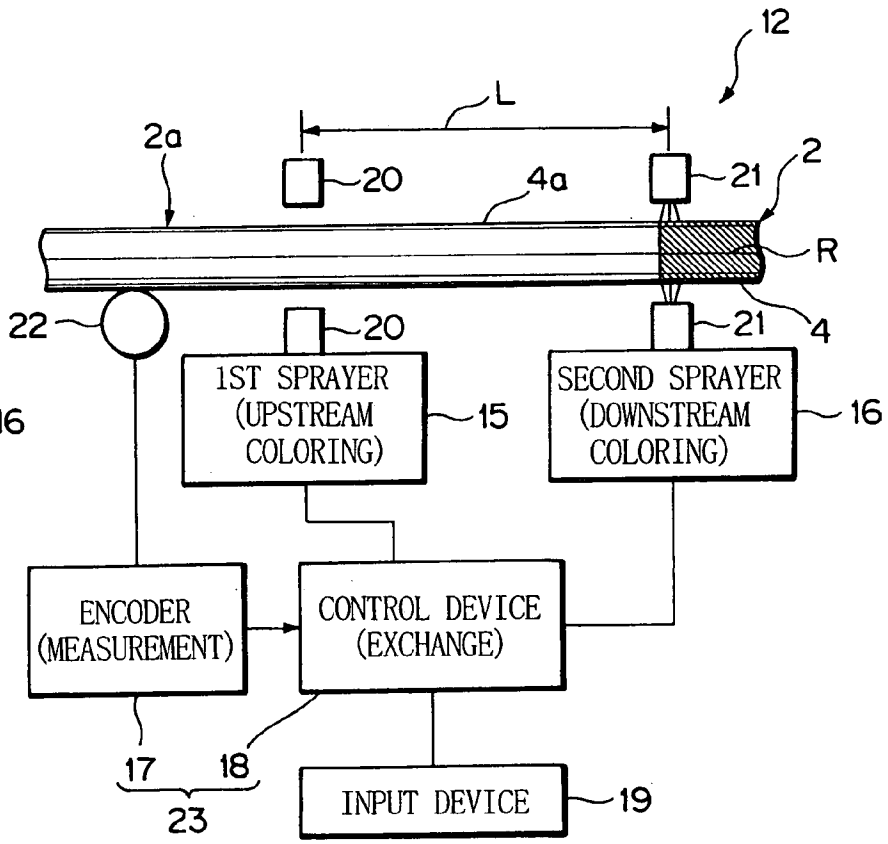
FIG. 9 is a view showing the state in which the electric wire is being colored by the second sprayer from the state of FIG. 8.

The second liquid supply source serves to supply the coloring liquid or paint of the second color (shaded by in FIGS. 8 and 9). The second gas supply source serves to supply pressurized gas into the second nozzle 21. In the configuration described above, the second sprayer 16 sprays the coloring liquid or paint with the second color B as well as the gas from the second nozzle 21 toward the outer surface of the cladding 4. The second sprayer 16 disperses the coloring liquid or paint (i.e. coloring agent) with the second color R into the gas so that it is sprayed to the outer surface of the cladding 4 in its "sol" (aerosol) state.

The second nozzles 21 of the second sprayer 16 are arranged downstream of the first nozzles 20 in the direction moving the core 3 indicated by arrow K. The second nozzles 21 are apart from the first nozzles 20 by distance K in the direction of arrow K. The distance L is equal to the interval between the first sprayer 15 and the second sprayer 16 in the direction of arrow K.

An exchanging portion 23 includes an encoder 17 serving as a measuring means and a control device 18 serving as an exchanging means. The encoder 17 is provided with a rotor 22. The rotor 22 is rotatable around the axis core. The outer surface of the rotor 22 is in contact with the cladding 4. The rotor 22, when the core 3, i.e. electric wire 2, 2*a* moves in the direction of arrow K, rotates. Namely, the rotor 22 rotates around the axis core with moving of the core 3, i.e. electric wire 2, 2*a*. It is of course that the moving distance of the core 3, i.e. electric wire 2 in the direction of arrow K is proportional to the number of revolutions of the rotor 22.

The encoder 17 is connected to the control device 18. The encoder 17, when the rotor 22 rotates by a prescribed angle, issues a pulsating signal to the control device 18. Namely, the encoder 17 issues the information corresponding to the moving direction of the core 3, i.e. electric wire 2, 2*a* in the direction of arrow K toward the control device 18. In this way, the encoder 17 measures the information corresponding to the moving distance of the electric wire 2, 2*a* and issues the information relative to any position of the electric wire 2.

The control device 18 is a computer equipped with a known RAM, ROM, CPU, etc. and controls the entire coloring unit 12. On the basis of the command received from an input device 19 or a program stored in the above ROM, the control device 18 operates one of the first sprayer 15 and the second sprayer 16 to color the outer surface of the cladding 4 with the first color B or second color R. The control device 18 stores the distance L between the nozzles 20 and 21.

The control device 18 changes the sprayer from the first sprayer 15 into the second sprayer 16 so that the state where the cladding 4 is colored with the first color B is changed into the state where the cladding 4 is colored with the second color R. Alternatively, The control device 18 changes the sprayer from the second sprayer 16 into the first sprayer 15 so that the state where the cladding 4 is colored with the second color R is changed into the state where the cladding 4 is colored with the first color B.

Where after the first sprayer 15 has been stopped, the second sprayer 16 is operated, i.e. the sprayer 15, 16 for coloring the outer surface 4*a* is changed from the first sprayer 15 to the second sprayer 16, the control device 18 stops the first sprayer 15 in the state where the first sprayer 15 is operating. In FIG. 6, the area being colored by the first sprayer 15 is shaded by B. Then, as shown in FIG. 7, the area shaded by B moves toward the second sprayer 16.

On the basis of the information supplied from the encoder 17, the control device 18 determines whether or not the core 3, i.e. the electric wire 2, 2*a* has moved by the distance L. If it is determined that the electric wire 2, 2*a* has moved by the distance L, as shown in FIG. 8, the second sprayer 16 is operated. In this way, after the first sprayer 15 has stopped, when the quantity of movement of the electric wire 2, 2*a* measured by the encoder 17 becomes equal to the distance L between the nozzles 20 and 21, the control device 18 operates the second sprayer 16. Then, as seen from FIG. 9, the outer surface of the cladding 4 of the electric wire 2, 2*a* is colored by the second sprayer 16. Incidentally, in FIGS. 8 and 9, the area colored by the second sprayer 16 is shaded by R.

Where after the second sprayer 16 has been stopped, the first sprayer 15 is operated, i.e. the sprayer for coloring the outer surface 4*a* is changed from the second sprayer 16 to the first sprayer 15, the control device 18 operates the first sprayer 16 in the state where the second sprayer 16 is operating. On the basis of the information supplied from the encoder 17, the control device 18 determines whether or not the core 3, i.e. the electric wire 2, 2*a* has moved by the distance L.

If it is determined that the electric wire 2, 2*a* has moved by the distance L, the second sprayer 16 is stopped. In this way, the control device 18 operates the first sprayer 15 in the state where the second sprayer 16 is operating and stops the sprayer 16 when the quantity of movement of the electric wire 2 measured by the encoder 17 becomes equal to the distance L between the nozzles 20 and 21.

As described above, on the basis of the information from the encoder 17, the control device 18 controls the sprayers 15 and 16 so that the first color B and the second color R do not overlap each other on the outer surface 4*a* of the cladding 4. The control device 18 controls the sprayers 15 and 16 so that the outer surface of the cladding 4 is necessarily colored with either one of the first color B and second color R. In the exchanging portion 23 having the configuration described above, on the basis of the information from the encoder 17, the control device 18 changes the sprayer 15, 16 for coloring the outer surface 4*a* of the cladding 4 to change the color which colors the outer surface 4*a* of the cladding 4.

The input device 19 is used to set the timing of changing the sprayer 15, 16, for example. Namely, the input device 19 is used to make various operations of the coloring unit 12. The input device 19 may be one of various devices for inputting information inclusive of a known keyboard, various switches, various recording medium driving device such as a CD-ROM drive.

The coloring unit 12 requires the sprayers 15 and 16 whose number corresponds to the number of colors used to color the electric wire 2. However, one of the sprayers 15 and 16 is operated, whereas the other sprayer may be washed for preparation of coloring of another color. Therefore, as long as there are at least two sprayers 15, 16, the electric wire 2 can be colored with various colors.

Figure 3:
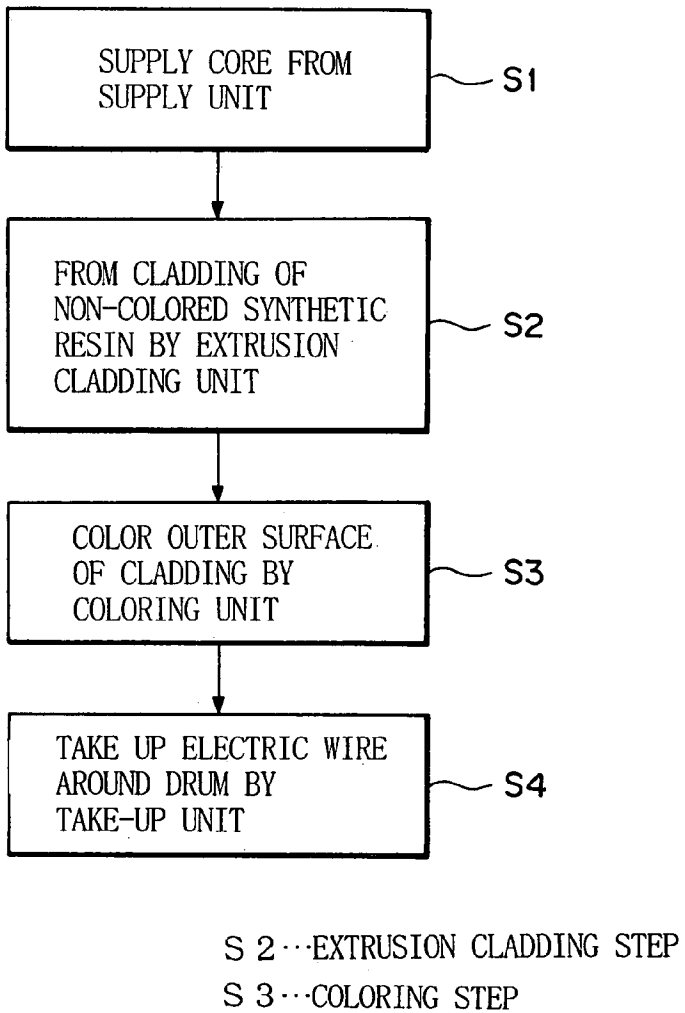
FIG. 3 is a flowchart showing the process for manufacturing the electric wire by the electric wire manufacturing apparatus shown in FIG. 1.

Now referring to FIG. 3, an explanation will be given of a process of manufacturing the electric wire 2 using the electric wire manufacturing apparatus 1 having the configuration described above.

In step S1, the core 3 is supplied from the supply unit 10. In step S2, in the extrusion cladding unit 11, the core 3 is coated with non-color synthetic resin by extrusion cladding to form the cladding 4, thereby providing the non-colored electric 2*a*. Step S2 refers to a cladding step in this specification.

Immediately after the cladding 4 has been formed, in step S3, the coloring unit 12 operates one of the sprayers 15 and 16 so that the outer surface 4*a* of the cladding 4 of the non-colored synthetic resin is colored with the coloring liquid or paint. In this step S3, the coloring unit 12 operates one of the sprayers 15 and 16 selected at a desired timing. Step S3 refers to a coloring step in this specification. The manufacturing process proceeds to step S4.

Step S3 or coloring step is implemented immediately after step S2 or extrusion cladding step. Since the coloring unit 12 is provided with the plurality of sprayers 15 and 16, the outer surface 4*a* of the cladding 4 can be colored with a plurality of colors. Therefore, the outer surface of the cladding 4*a* can be colored with the color selected from these plurality of colors, and the color can be changed as necessary.

In step S4, the take-up unit 13 cuts the electric wire 2, composed of the core 3 and cladding 4 colored by the coloring unit 12, into segments each having a desired length which are wound around the drum. Thus, the electric wire 2 constituting the wire harness 2 can be manufactured.

In this embodiment, the step S2 for forming the cladding 4 and the step S3 for coloring the outer surface 4*a* of the cladding 4 of the electric wire 2 are implemented individually Therefore, by changing the color in step S3, the color for the outer surface 4*a* of the cladding 4 of the electric wire 2 can be easily changed.

Further, in step S2 or by the extrusion cladding unit 11, the cladding 4 is formed of the non-color synthetic resin. Therefore, the product numbers (kinds of the color coloring the outer surface 4*a*) of the electric wire 2*a* which is obtained by extrusion cladding can be reduced. Thus, the space for storing the electric wire 2*a* and effort to manage the product numbers can be also reduced.

In step S3 or by the coloring unit 12, the outer surface 4*a* of the non-colored cladding 4 is colored. Therefore, even when the outer surface 4*a* of the non-colored cladding 4 is colored with the color having higher brightness than that of the outer surface 4*a*, the non-colored resin can be hidden by the color adopted in step S3 by the coloring unit 12. Therefore, in step S3 or by the coloring unit 12, the electric wire 2 can be colored with any color which can be changed without limit. Thus, the limitation when the color for coloring electric wire 2 is changed can be removed.

Further, step S3 is executed immediately after step S2. Namely, the coloring unit 12 is arranged immediately downstream of the exclusion cladding unit 11 in the direction K of moving the core 3. The coloring unit 12 sprays the coloring agent in a sol state. Therefore, the temperature of the cladding 4 heated to a high temperature in step S2 can be reduced by the evaporation heat when the coloring agent in the sol state used for coloring in step S3 is dried. In step S3, since the cladding 4 is cooled, the step or device for cooling the cladding 4 can be omitted.

The cladding 4 heated to the high temperature in step S2 is colored. The electric wire 2 shown in FIG. 5 is made in such a way that the outer surface 4*a* of the cladding 4 heated to the high temperature by exclusion cladding is colored. In coloring the outer surface 4*a* of the cladding 4, the control device 18 changes the sprayer between the sprayers 15 and 16 on the basis of the information from the encoder 17.

Thus, since the outer surface of the cladding 4 is colored before the synthetic resin constituting the cladding 4 is hardened, the dye of the coloring agent is liable to sink within the cladding 4, and the pigment of the paint is liable to bond to the outer surface 4*a* of the cladding 4. Therefore, the dye or pigment is difficult to come off from the outer surface of the cladding 4. The electric wire thus formed can be used as the electric wire which is arranged in a motor vehicle. Further, since the cladding 4 heated to the high temperature is colored, heating for drying is not required after the cladding has been colored using the coloring liquid or paint. Therefore, the electric wire manufacturing device 1 can be further miniaturized.

Further, since the cladding 4 at the high temperature is sprayed with the coloring agent, the cladding 4 does not suffer from adverse effects (reduction in the mechanical strength and surface corrugation) as compared with the case where the cladding is previously treated using known swelling agent, solvent, plastic agent, etc. before the coloring agent is sprayed.

Further, the coloring unit 12 is provided with the plurality of sprayers 15 and 16. Therefore, the electric wire 2 can be colored with the plurality of colors so that the color for coloring can be easily changed by exchanging the sprayers 15, 16.

Further, in step S3, i.e. by the coloring unit 12, the color applied to the outer surface 4*a* of the cladding 4 can be changed. Therefore, in step S3, i.e. by the coloring unit 12, the cladding 4 can be colored with various colors. Thus, in changing the color applied to the cladding 4, it is not necessary to stop the coloring unit 12 or electric wire manufacturing apparatus temporarily, thereby preventing the efficiency of manufacturing the electric wire 2 from being reduced.

The coloring unit 12 is provided with the plurality of sprayers 15 and 16. Therefore, the electric wire 2 can be colored with the plurality of colors. The control device 18 can change the sprayer between the sprayers 15 and 16. For this reason, without temporarily stopping the coloring unit 12, i.e. the electric wire manufacturing apparatus 1, the color applied to the electric wire 2 can be easily changed, thereby preventing the efficiency of manufacturing the electric wire from being reduced.

Further, the encoder 17 can acquire the information corresponding to the moving distance of the electric wire 2 to measure any position of the electric wire 2. For this reason, when the sprayers 15 and 16 are exchanged, the area where the plurality of colors overlap on the electric wire 2 and the non-colored area can be suppressed. This suppresses reduction in the material yield of the electric wire 2.

The sprayers 15 and 16 spray the coloring agent in the sol state. Therefore, when the control device 18 changes the sprayer between the sprayers 15 and 16, the color applied to the electric wire 2 can be changed immediately. For this reason, when the sprayers 15 and 16 are exchanged, the area where the plurality of colors overlap on the electric wire 2 and the non-colored area can be suppressed. This suppresses reduction in the material yield of the electric wire 2.

When the sprayer 15, 16 is changed, the color applied to the electric wire 2 can be immediately changed. Therefore, the interval L between the sprayers 15 and 16 can be narrowed. Thus, the coloring unit 12, i.e. the electric wire manufacturing apparatus 1 can be miniaturized.

The electric wire 2 colored by the coloring unit 12 is manufactured by the electric wire manufacturing apparatus 1. The coloring unit 12 includes the sprayers 15, 16 which spray the coloring agent in the sol state, encoder 17 for acquiring the information on the movement of the electric wire 2 and the control device 18 which switches between the sprayers 15 and 16. Therefore, the boundary S between the first area 31 colored with the first color B and the second area 32 colored with the second color R can be clarified. This avoids any overlapping portion of the first color B and the second color R and the area not colored with both colors B and R, thereby suppressing reduction in the material yield of the electric wire 2.

In the embodiment described above, the encoder 17 measures any position of the electric wire 2. However, in place of the encoder, this invention can adopt an image pick-up means such as a CCD camera and a discriminating means for identifying any position of the electric wire 2 from the image acquired by the image pick-up means.

In the embodiment described above, the coloring unit 12 is arranged immediately downstream of the extrusion cladding unit 11. However, in this invention, the coloring unit 12 may be attached integrally to the take-up unit 13. In short, in this invention, after the core 3 has been coated with the cladding 3, the coloring unit 2 may be arranged at any position in the electric wire manufacturing apparatus 1.

Further, in the embodiment described above, the sprayers 15 and 16 are used as a coloring portion of the coloring unit 12. However, in this invention, as the coloring portion in the coloring unit 12, a marker for applying paint or pigment on the outer surface 4*a* may be arranged in contact with the outer surface 4*a* of the cladding 4.

Further, in the embodiment described above, the sprayers 15 and 16 spray the aerosol composed of the coloring liquid or paint and gas onto the outer surface of the cladding 4. However, in this invention, as long as the coloring liquid or paint sprayed onto the outer surface 4*a* of the cladding 4 from the sprayers 15 and 16 is in the sol state, various kinds of gases may be used in place of the gas.

Further, in the embodiment described above, the electric wire 2 constituting the wire harness arranged in a motor vehicle was employed. However, the electric wire 2 manufactured by the manufacturing apparatus 1 according to this invention may be applied to various electronic devices or various electric machine such as a portable computer as well as the motor vehicle.

Additionally, in this invention, as the means for coloring the outer surface 4*a* of the cladding 4, various means inclusive of immersion, spraying, jetting, printing, transfer, etc. may be employed. Further, as the coloring liquid and paint, acryl paint, ink (dye or pigment), UV ink may be employed.

INDUSTRIAL APPLICABILITY

As understood from the description hitherto made, in an embodiment of the present invention, the extrusion cladding step and the coloring step are individually implemented. Therefore, by changing the color in the coloring step, the color applied to the electric wire can be easily changed. In the extrusion cladding step, the cladding is formed from non-colored synthetic resin. Therefore, the product numbers (kinds of the color coloring the outer surface) of the electric wire which is obtained by extrusion cladding can be reduced. Thus, the space for storing the electric wire 2*a* and effort to manage the product numbers can be also reduced.

In another embodiment of the present invention, since the coloring step is executed immediately after the extrusion cladding step, the temperature of the cladding heated to a high temperature in the extrusion cladding step can be reduced by the evaporation heat when the coloring agent used in the coloring step is dried. Therefore, in addition to suppressing the limitation in changing the color applied to the electric wire, the cladding is cooled in the coloring step so that the step for cooling the cladding can be reduced.

Further, the cladding heated to the high temperature in the extrusion cladding step is colored. Thus, since the outer surface of the cladding is colored before the synthetic resin constituting the cladding is hardened, the dye of the coloring agent is liable to sink within the cladding, and the pigment of the paint is liable to bond to the outer surface of the cladding. Therefore, the dye or pigment is difficult to come off from the outer surface of the cladding. The electric wire thus formed can be used as the electric wire which is arranged in a motor vehicle. Further, since the cladding heated to the high temperature is colored, heating for drying is not required after the cladding has been colored using the coloring liquid or paint.

Further, since the cladding 4 at the high temperature is sprayed with the coloring agent, the cladding 4 does not suffer from adverse effects (reduction in the mechanical strength and surface corrugation) as compared with the case where the cladding is previously treated using known swelling agent, solvent, plastic agent, etc. before the coloring agent is sprayed.

In another embodiment of the present invention, in the coloring step, the outer surface of the cladding can be colored with a plurality of colors, and the color applied to the outer surface can-be changed. Therefore, the cladding can be colored with various colors which can be changed. Accordingly, in addition to suppressing the limitation in changing the color applied to the electric wire, the color applied to the cladding in the coloring step can be easily changed. This suppresses reduction in the electric wire manufacturing efficiency.

In another embodiment of the present invention, any position of the electric wire is measured to exchange the plurality of coloring portions. Therefore, the electric wire can be colored with a plurality of colors. In addition, without stopping the operation of manufacturing the electric wire temporarily, the color applied to the electric wire can be easily changed, and reduction in the electric wire manufacturing efficiency can be suppressed.

Further, any position of the electric wire can be measured. Therefore, when the coloring portions are exchanged, any overlapping portion of the first color and the second color can be avoided and the area not colored with both colors can be avoided. Therefore, the boundary between the first area colored with the first color and the second area colored with the second color can be clarified. Thus, reduction in the material yield of the electric wire can be suppressed.

In another embodiment of the present invention, the upstream coloring portion is stopped, and when the electric wire moves over an interval between said coloring portions while an upstream coloring portion of the coloring portions is stopped, the downstream coloring portion thereof is operated. Therefore, when the coloring portions are exchanged, any overlapping portion of the first color and the second color can be avoided and the area not colored with both colors can be avoided. Therefore, the boundary between the first area colored with the first color and the second area colored with the second color can be clarified. Accordingly, reduction in the material yield of the electric wire can be suppressed.

In another embodiment of the present invention, where the upstream coloring portion of the coloring portions is operated while a downstream coloring portion thereof is operated, when the electric wire moves over an interval between said coloring portions, the downstream portion is stopped. Therefore, when the coloring portions are exchanged, any overlapping portion of the first color and the second color can be avoided and the area not colored with both colors can be avoided. Therefore, the boundary between the first area colored with the first color and the second area colored with the second color can be clarified. Accordingly, reduction in the material yield of the electric wire can be suppressed.

In another embodiment of the present invention, the extrusion cladding unit of forming the cladding and the coloring unit of coloring the electric wire are individually provided. Therefore, by changing the color in the coloring step, the color applied to the electric wire can be easily changed.

In the extrusion cladding step, the cladding is coated with the non-color synthetic resin. Therefore, the product numbers (kinds of the color of the outer surface) of the electric wire which is obtained by the extrusion cladding unit can be reduced. Thus, the space for storing the electric wire and effort to manage the product numbers can be also reduced.

In the coloring unit, the outer surface of the non-colored cladding is colored. Therefore, even when the outer surface of the non-colored cladding is colored with the color having higher brightness than that of the outer surface, the non-colored resin can be hidden by the color adopted in the coloring unit. Therefore, in the coloring step, the electric wire can be colored with any color which can be changed without limit. Accordingly, the limitation when the color for coloring electric wire is changed can be removed.

In another embodiment of the present invention, since the coloring unit is arranged immediately after the extrusion cladding unit, the temperature of the cladding heated to a high temperature in the extrusion cladding unit can be reduced by the evaporation heat during coloring in the coloring unit. Therefore, in addition to the limitation of changing the color applied to the electric wire, the cladding can be cooled by the coloring unit so that the unit for cooling the cladding and the electric wire manufacturing apparatus can be miniaturized.

Further, the cladding heated to the high temperature in the extrusion cladding step is colored. Thus, since the outer surface of the cladding is colored before the synthetic resin constituting the cladding is hardened, the dye of the coloring agent is liable to sink within the cladding, and the pigment of the paint is liable to bond to the outer surface of the cladding. Therefore, the dye or pigment is difficult to come off from the outer surface of the cladding. The electric wire thus formed can be used as the electric wire which is arranged in a motor vehicle. Further, since the cladding heated to the high temperature is colored, heating for drying is not required after the cladding has been colored using the coloring liquid or paint.

Further, since the cladding at the high temperature is sprayed with the coloring agent, the cladding does not suffer from adverse effects (reduction in the mechanical strength and surface corrugation) as compared with the case where the cladding is previously treated using known swelling agent, solvent, plastic agent, etc. before the coloring agent is sprayed.

In another embodiment of the present invention, the coloring unit includes a plurality of coloring portions and the exchanging portion. Therefore, by exchanging the coloring portions to operate in the coloring unit, the outer surface of the cladding can be colored with various colors. Thus, in addition to suppressing the limitation of changing the color applied to the electric wire, the color applied to the cladding in the coloring unit can be easily changed. Accordingly, reduction in the efficiency of manufacturing the electric wire can be suppressed.

In another embodiment of the present invention, the coloring unit includes the plurality of coloring portions. Therefore, the electric wire can be colored with the plurality of colors.

In addition, the exchanging means can exchange the coloring portions. Therefore, without temporarily stopping the coloring unit, i.e. electric wire manufacturing apparatus, the color applied to the electric wire can be easily changed. Thus, the color applied to the electric wire can be easily changed and reduction in the efficiency of manufacturing the electric wire can be suppressed.

Further, the measuring means can measure any position of the electric wire. Therefore, when the coloring portions are exchanged, any overlapping portion of the first color and the second color can be avoided and the area not colored with both colors can be avoided. Accordingly, reduction in the material yield of the electric wire can be suppressed.

In another embodiment of the present invention, the measuring means measures any position of the electric wire by measuring the information corresponding to a quantity of movement of the electric wire. Therefore, when the coloring portions are exchanged, any overlapping portion of the first color and the second color can be avoided and the area not colored with both colors can be avoided. Accordingly, the color applied to the electric wire can be easily changed and reduction in the material yield of the electric wire can be suppressed.

In another embodiment of the present invention, the exchanging means stops the upstream coloring portion and operates said downstream coloring portion when a quantity of movement of the electric wire measured by said measuring means becomes equal to the interval between said plurality of coloring portions. Therefore, when the coloring portions are exchanged, any overlapping portion of the first color and the second color can be avoided and the area not colored with both colors can be avoided. Accordingly, the color applied to the electric wire can be easily changed and reduction in the material yield of the electric wire can be suppressed.

In another embodiment of the present invention, said exchanging means operates said upstream coloring portion while said downstream coloring portion is being operated, and stops said downstream coloring portion when a quantity of movement of the electric wire measured by said measuring means becomes equal to the interval between said plurality of coloring portions. Therefore, when the coloring portions are exchanged, any overlapping portion of the first color and the second color can be avoided and the area not colored with both colors can be avoided. Accordingly, the color applied to the electric wire can be easily changed and reduction in the material yield of the electric wire can be suppressed.

In another embodiment of the present invention, the coloring portion sprays the coloring agent in a sol state. Therefore, when the exchanging means exchanges the coloring portions, the color applied to the electric wire can be changed immediately. Therefore, the color applied to the electric wire can be changed more easily, and when the coloring portions are exchanged, any overlapping portion of the first color and the second color can be avoided and the area not colored with both colors can be avoided. Accordingly, reduction in the material yield of the electric wire can be suppressed.

When the coloring portion is changed, the color applied to the electric wire can be immediately changed. Therefore, the interval between the coloring portions can be narrowed. Thus, the coloring unit, i.e. the electric wire manufacturing apparatus can be miniaturized.

In another embodiment of the present invention, the cladding heated to the high temperature by the extrusion cladding is colored. Thus, since the outer surface of the cladding is colored before the synthetic resin constituting the cladding is hardened, the dye of the coloring agent is liable to sink within the cladding, and the pigment of the paint is liable to bond to the outer surface of the cladding. Therefore, the dye or pigment is difficult to come off form the outer surface of the cladding. The electric wire thus formed can be used as the electric wire which is arranged in a motor vehicle.

In another embodiment of the present invention, any position is measured and the coloring portions are exchanged to color the outer surface. Therefore, the boundary between the first area colored with the first color and the second area colored with the second color can be clarified, thereby further suppressing the reduction in the material yield of the electric wire.

In another embodiment of the present invention, an upstream coloring portion of said coloring portions is stopped, and when the electric wire is moved over an interval between said coloring portions while a downstream coloring portion is operated to color the outer surface. Therefore, when the coloring portions are exchanged, any overlapping portion of the first color and the second color can be avoided and the area not colored with both colors can be avoided. Thus, the boundary between the first area colored with the first color and the second area colored with the second color can be clarified, thereby further suppressing the reduction in the material yield of the electric wire.

In another embodiment of the present invention, the upstream coloring portion of the coloring portions is operated while a downstream coloring portion thereof is being operated, and the downstream coloring portion is stopped after the electric wire moves over an interval between the coloring portions. Therefore, when the coloring portions are exchanged, any overlapping portion of the first color and the second color can be avoided and the area not colored with both colors can be avoided. Thus, the boundary between the first area colored with the first color and the second area colored with the second color can be clarified, thereby further suppressing the reduction in the material yield of the electric wire.

The invention claimed is:

1. An electric wire comprising:

a conductive core and a cladding which clads the core, the cladding being formed by extrusion cladding insulating synthetic resin around the core;

wherein an outer surface of said cladding is colored immediately after extrusion cladding and, before the synthetic resin constituting the cladding hardens, so that the coloring agent sinks into the cladding or bonds to the outer surface of the cladding;

a plurality of coloring portions color the outer surface of the cladding, each coloring portion being capable of applying a single color;

the coloring portions color the outer surface of said cladding with a coloring agent, the coloring agent being a liquid coloring material dissolved or dispersed in water or other solvent;

a rotatable rotor, a part of which contacts the outer surface of the cladding straightly moving, measures a moving distance of the cladding; and the coloring portions are selectively operated to color the outer surface of the cladding in intervals in relation to the position of the coloring portions so that the outer surface is composed of a first area colored in a first color, a second area colored in a second color and a boundary therebetween without overlapping each other.

2. An electric wire according to claim 1, characterized in that said electric wire is manufactured by moving said core; said coloring portions are apart from one another in a direction of moving the core; and after the electric wire is moved over an interval between said coloring portions while an upstream coloring portion of said coloring portions stops, a downstream coloring portion is operated.

3. An electric wire according to claim 1, characterized in that said electric wire is manufactured by moving said core; said coloring portions are apart from one another in a direction of moving the core; and an upstream coloring portion of the coloring portions is operated while a downstream coloring portion thereof is being operated, and the downstream coloring portion is stopped after the electric wire moves over an interval between the coloring portions.

4. A method for manufacturing an electric wire comprising a conductive core and a cladding which is made of insulating synthetic resin and clads the core, the method comprising the step of:

(1) moving straightly the core in a downstream direction;

(2) cladding an outer periphery of said core with non-colored synthetic resin by extrusion cladding to form said cladding;

(3) making a part of a rotatable rotor contact an outer surface of the cladding straightly moving and measuring intervals of the cladded core;

(4) issuing a pulsating signal corresponding to an angle of rotation of the rotor from a measuring means to an exchanging means; and (5) coloring an outer surface of said cladding of non-colored synthetic resin with a coloring agent, the coloring agent being a liquid coloring material dissolved or dispersed in water or other solvent;

wherein coloring portions are positioned along the downstream direction;

the coloring portions color the outer surface of the cladding;

said coloring step is executed immediately after said extrusion cladding step and before the synthetic resin constituting the cladding hardens, so that the coloring agent sinks into the cladding or bonds to the outer surface of the cladding;

the outer surface of said cladding is colored with a plurality of colors by a plurality of coloring portions, each coloring portion being capable of applying a single color;

a length of movement of the cladded core is measured with the measuring means;

the measured length is determined to be equal to a distance between the coloring portions; and the color applied to the outer surface is changed when the measured length is equal to the distance so that the colors do not overlap each other on the outer surface of the cladding.

5. A method for manufacturing an electric wire according to claim 4, characterized in that in said coloring step (4), the outer surface of said cladding is colored by coloring portions selected for operation according to the intervals of the cladded core measured in step (3) and the position of the coloring portions.

6. A method for manufacturing an electric wire according to claim 5, characterized in that the core of the electric wire is moved to manufacture the electric wire; said coloring portions are apart from one another in a direction of moving said core; and when said electric wire moves over an interval between said coloring portions while an upstream coloring portion of the coloring portions is stopped, a downstream coloring portion thereof is operated.

7. A method for manufacturing an electric wire according to claim 5, characterized in that the core of the electric wire is moved to manufacture the electric wire; said coloring portions are apart from one another in a direction of moving said core; and where an upstream coloring portion of the coloring portions is operated while a downstream coloring portion thereof is operated, when said electric wire moves over an interval between said coloring portions, said downstream portion is stopped.

8. An apparatus for manufacturing an electric wire composed of a conductive core and a cladding which is made of insulating synthetic resin and clads the core, the apparatus comprising:

an extrusion cladding unit for cladding an outer periphery of said core with non-colored synthetic resin by extrusion cladding to form said cladding; and;

a coloring unit for coloring an outer surface of said cladding of non-colored synthetic resin with a coloring agent, the coloring agent being a liquid coloring material dissolved or dispersed in water or other solvent;

wherein said coloring unit is arranged downstream of and immediately after said extrusion cladding unit in a direction of moving said core so as to be able to apply coloring agent before the synthetic resin has hardened;

said coloring unit includes a plurality of coloring portions and an exchanging portion;

the exchanging portion includes a measuring means for measuring an optional position of said electric wire in intervals that relate to the position of the coloring portions and having a rotatable rotor a part of which is in contact with the outer surface of the cladding straightly moving, and an exchanging means for selectively operating the coloring portions in relation to the intervals measured by said measuring means based on a distance between the coloring portions, a value of the distance being stored in the exchanging means, and the exchanging portion controls the selective operation of coloring portions;

each coloring portion is capable of coloring the outer surface of the cladding in a single color;

the coloring portions color the outer surface of the cladding immediately after the extrusion cladding so that the coloring agent sinks into the cladding or bonds to the outer surface of the cladding.

9. An apparatus for manufacturing an electric wire according to claim 8, characterized in that said coloring portions are arranged apart from each other in a direction of moving the core; and said measuring means measures said optional position by measuring information corresponding to a quantity of movement of the electric wire in a direction of moving said core.

10. An apparatus for manufacturing an electric wire according to claim 9, characterized in that when said exchanging means changes the coloring portion for coloring said outer surface from an upstream coloring portion of the coloring portions to a downstream coloring portion thereof in a direction of moving the core, the exchanging portion stops the upstream coloring portion and operates said downstream coloring portion when a quantity of movement of the electric wire measured by said measuring means becomes equal to the interval between said plurality of coloring portions.

11. An apparatus for manufacturing an electric wire according to claim 9, characterized in that when said exchanging means changes the coloring portion for coloring said outer surface from a downstream coloring portion of the coloring portions to an upstream coloring portion thereof in a direction of moving the core, said exchanging portion operates said upstream coloring portion while said downstream coloring portion is being operated, and stops said downstream coloring portion when a quantity of movement of the electric wire measured by said measuring means becomes equal to the interval between said plurality of coloring portions.

12. An apparatus for manufacturing an electric wire according to claim 8, characterized in that each of said coloring portions sprays a coloring agent in a sol state on said outer surface of the cladding.

* * * * *